United States Patent [19]

Braml

[11] 4,253,793

[45] Mar. 3, 1981

[54] QUICK ATTACHMENT FOR LOADER IMPLEMENTS

[76] Inventor: Michael T. Braml, 6601 Zeland Ave., Minneapolis, Minn. 55428

[21] Appl. No.: 47,887

[22] Filed: Jun. 11, 1979

[51] Int. Cl.[3] ..... E02F 3/81

[52] U.S. Cl. ..... 414/723; 172/273

[58] Field of Search ..... 414/723; 172/272, 273

[56] References Cited

U.S. PATENT DOCUMENTS

| | | | |
|---|---|---|---|
| 3,243,066 | 3/1966 | Gardner et al. | 414/723 X |
| 3,417,886 | 12/1968 | Stuart | 414/723 |
| 3,543,863 | 12/1970 | Ball | 414/723 X |
| 3,672,521 | 6/1972 | Bauer et al. | 414/723 |
| 3,760,883 | 9/1973 | Birk | 414/723 X |
| 3,767,075 | 10/1973 | Leverenz | 414/723 X |
| 3,935,953 | 2/1976 | Stedman | 414/723 X |
| 3,985,249 | 10/1976 | Aker et al. | 414/723 |
| 4,116,346 | 9/1978 | Uchida | 414/723 |
| 4,116,347 | 9/1978 | Uchida | 414/723 |
| 4,136,792 | 1/1979 | Wilson | 414/723 |
| 4,187,050 | 2/1980 | Barbee | 414/723 |

FOREIGN PATENT DOCUMENTS

| | | | |
|---|---|---|---|
| 1164323 | 2/1964 | Fed. Rep. of Germany | 414/723 |
| 2327946 | 5/1977 | France | 414/723 |
| 216635 | 10/1967 | Sweden | 414/723 |

*Primary Examiner*—James L. Rowland

*Attorney, Agent, or Firm*—Burd, Bartz & Gutenkauf

[57] ABSTRACT

A vehicle, such as a front end loader, having a work implement, a boom for raising and lowering the implement, and a tilt mechanism for pivoting the implement, includes a quick attach mounting assembly for releasably attaching various work implements such as buckets, snow plows, or grapples to the boom and tilt mechanisms. The quick attach assembly includes upper and lower trunnion pins in fixed spaced apart relationship on the back of the work implement, and a mounting unit pivotally mounted and interconnected between the boom and tilt mechanism which includes a frame, an upper trunnion-engaging member mounted on the frame engageable with the upper trunnion pin, and a lower trunnion-engaging member in the form of a pair of spaced pawls pivotally mounted on the frame that are engageable with the lower trunnion pins on the implement. The lower trunnion-engaging pawls include free swinging notched end portions that are normally biased by gravity to a non-engaged position in which the notched ends face forwardly from the boom. In operation, upon engagement of the saddle of the upper trunnion-engaging member with the upper trunnion pin and a slight elevation of the boom, the work implement pivots about the upper trunnion pin to move the lower trunnion pins into engagement with the notched end of the pawls, and to then pivot the pawls to a locking position. There is also provided lock means for securing the lower trunnion-engaging pawls in the locking position.

6 Claims, 7 Drawing Figures

Fig. 5
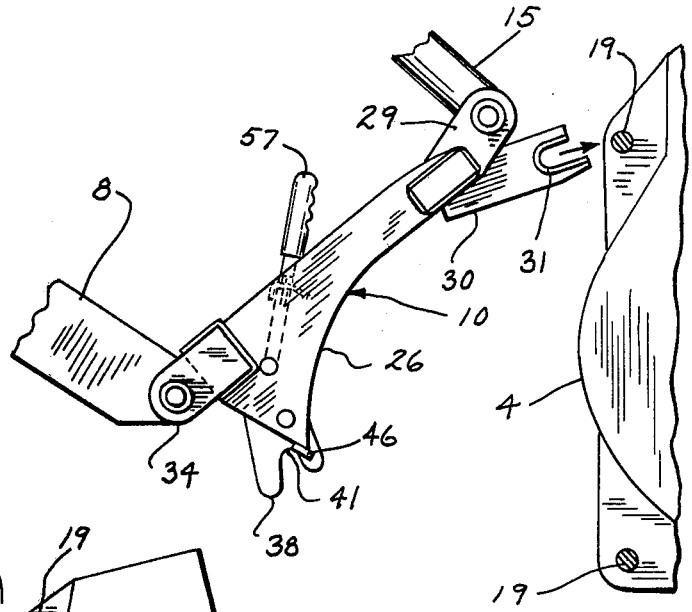
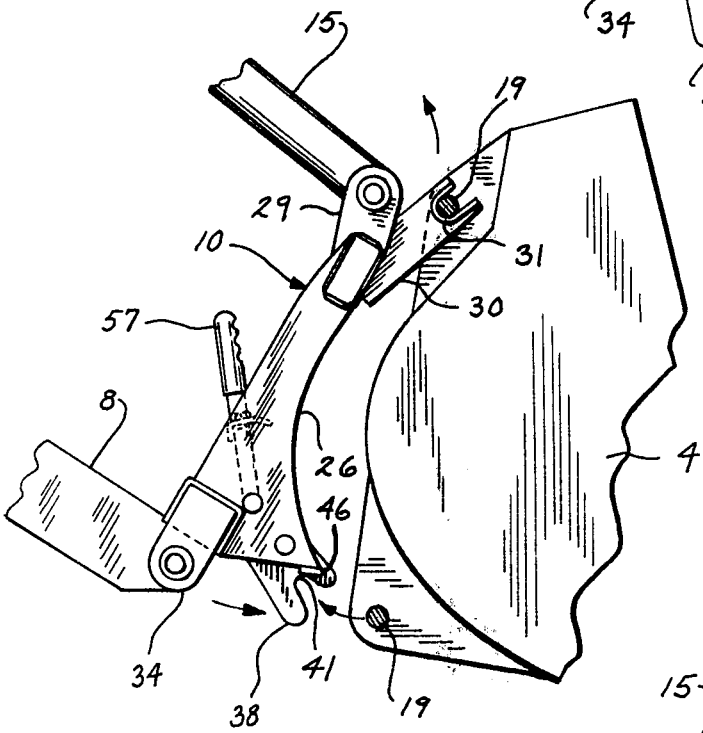
Fig. 6
Fig. 7
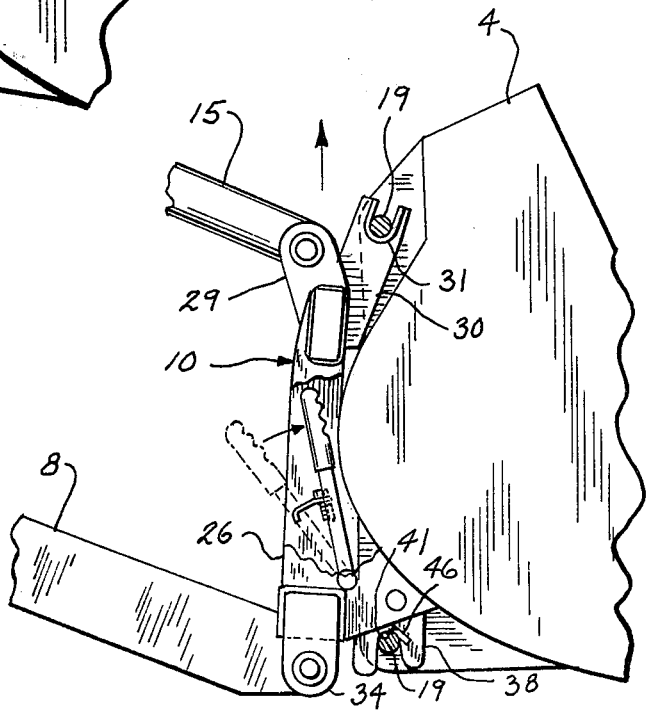

QUICK ATTACHMENT FOR LOADER IMPLEMENTS

BACKGROUND OF THE INVENTION

This invention relates to mountings for attaching work implements to a vehicle, and more particularly, to a quick attach mounting assembly for releasably connecting work implements such as buckets, snow plows, grapples and the like to the front of an articulated loader.

Conventional front end loaders are generally wheeled or tracked vehicles having a work implement mounted on the outer end of a boom which extends from the front of the machine. A hydraulic hoist cylinder is generally used to raise and lower the boom and work implement. Pivoting of the work implement may be provided by a tilt mechanism which generally includes a linkage actuated by a hydraulic tilt cylinder. Front end loaders of this type are versatile machines which may be used for various job applications with numerous work implements. This versatility has led to the need for a quick attach mounting assembly for readily connecting and disconnecting the various work implements to the loader.

The prior art has provided various forms of attachment mechanisms for such vehicles. One form of an attachment generally employs a hook arrangement whereby a member on the back of a work implement is brought into hooking engagement with a complementary member secured to the boom of the vehicle. Once initial engagement of the hook arrangement occurs, the implement may be raised or tilted to align openings in a pinning arrangement at its other end. A pin is then manually inserted through the aligned openings to secure the implement to the vehicle. Examples of such arrangements are disclosed in U.S. Pat. No. 3,767,075 issued to Leverenz for a "Bucket Loader," and U.S. Pat. No. 3,417,886 issued to Stuart for an "Implement Hitch for Tractors and Loaders." This type of attachment, however, generally requires precise alignment to close tolerances of the openings in the pinning arrangement in order to manually pin and secure the work implement. These attachments may thus require considerable amount of time to properly align the pinning arrangement before securing various work implements, especially if several changes a day are necessary.

Another type of attachment is shown in U.S. Pat. No. 3,760,883 issued to Birk entitled "Quick Hitch Assembly," and U.S. Pat. No. 3,243,066 issued to Gardner entitled "Quick Change Means for Loader Attachments." These attachments generally employ a hook arrangement similar to those previously discussed along with hydraulic cylinders which are actuated to insert and retract pins through aligned openings in a pinning arrangement. This type of attachment, however, also requires precise alignment of the openings in the pinning arrangement. Further, damage to the hydraulic cylinder or pins may result if the hydraulic cylinder is actuated and the pinning arrangement is misaligned.

Still another type of attachment assembly is shown in U.S. Pat. No. 3,935,953 issued to Stedman entitled "Implement Mounting Means for Earthworking Vehicles." This arrangement comprises over-center toggle mechanisms which engage hook members mounted on the back of work implements. The arrangement includes hydraulic locking mechanisms on the boom which must be aligned with openings in the toggle mechanisms prior to connecting or disconnecting the work implements. Precise and proper alignment of locking and toggle mechanisms of this type requires considerable time, and if misaligned, damage to the locking mechanisms can occur.

Unlike the prior art, a quick attach mounting assembly for loader implements in accordance with the present invention employs an arrangement which readily permits connecting and disconnecting work implements without employing hydraulic cylinders and without the necessity of aligning openings in pinning arrangements.

SUMMARY OF THE INVENTION

The present invention resides in a quick attach assembly for releasably attaching a work implement to a boom of a vehicle, there being upper and lower projections on the implement mounting unit forming an interface between the boom and implement that is pivotally connected to the boom and is engageable with the upper projections. Such unit includes a pivotally mounted pawl engageable with the lower implement projection that is biased to a non-engaged position, but upon engagement of the unit with the upper implement projection and an operation of the boom it comes into engagement with the lower projection and then swings into an implement locking position.

Front end loader vehicles may generally be employed with numerous work implements that are interchangeable depending upon the desired job requirements. Such versatility greatly increases the economic value of these machines by substantially increasing their scope of applications. It is therefore desirable to provide a mounting assembly for releasably attaching these various work implements to the loader vehicle which will save time in changing implements, and thus further increase the productivity of these machines. The present invention seeks to solve this problem by providing a quick attach assembly for a front end loader which in one form includes upper and lower trunnion means having transversely mounted trunnion pins on the rear of a work implement in fixed spaced apart relationship, and a mounting unit pivotally connected at its upper end to the tilt mechanism of the loader and at its lower end to the boom of the loader which includes a frame, an upper trunnion-engaging member mounted on the upper end of the frame having a saddle engageable with the upper trunnion pin, a lower trunnion-engaging member in the form of a pair of pawls pivotally mounted on the lower end of the frame and engageable in their operative position with the lower trunnion pins, and lock means for releasably securing the lower trunnion-engaging pawls in their operative position. The lower trunnion-engaging pawls are normally biased to a non-engaged position facing forwardly, but upon engagement of the saddle of the upper trunnion-engaging member with the upper trunnion pin and a slight elevation of the boom the work implement pivots about the upper trunnion pin to move the lower trunnion pins into engagement with the pawls and pivots the pawls to their operative position. The normal arrangement of the boom and tilt mechanism of the loader need not be changed or altered in order to accommodate the invention.

It is a general object of the invention to provide a mounting assembly for releasably attaching various work implements to the boom and tilt mechanism of a front end loader.

It is another object of the invention to provide an arrangement for releasably attaching work implements to a vehicle which permits the implements to be quickly and easily changed.

It is yet another object of the invention to provide an arrangement for releasably attaching work implements to a vehicle which does not require aligning openings in pinning arrangements.

It is still another object of the invention to provide an arrangement for releasably attaching work implements to a vehicle without the use of auxiliary hydraulics.

It is another object of the invention to provide an arrangement for releasably attaching work implements to a vehicle which is reliable, easy to install and maintain, and which does not add appreciable bulk to the vehicle's front end.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not represent the full scope of the invention, but rather the invention may be employed in different embodiments, and reference is made to the claims herein for interpreting the breadth of the invention.

BRIEF DESCRIPTION OF THE DRAWINGS

FIGS. 5–7 illustrate the manner in which the quick attach assembly of FIG. 1 attaches and secures a work implement during operation.

DESCRIPTION OF THE PREFERRED EMBODIMENT

Figure 1:
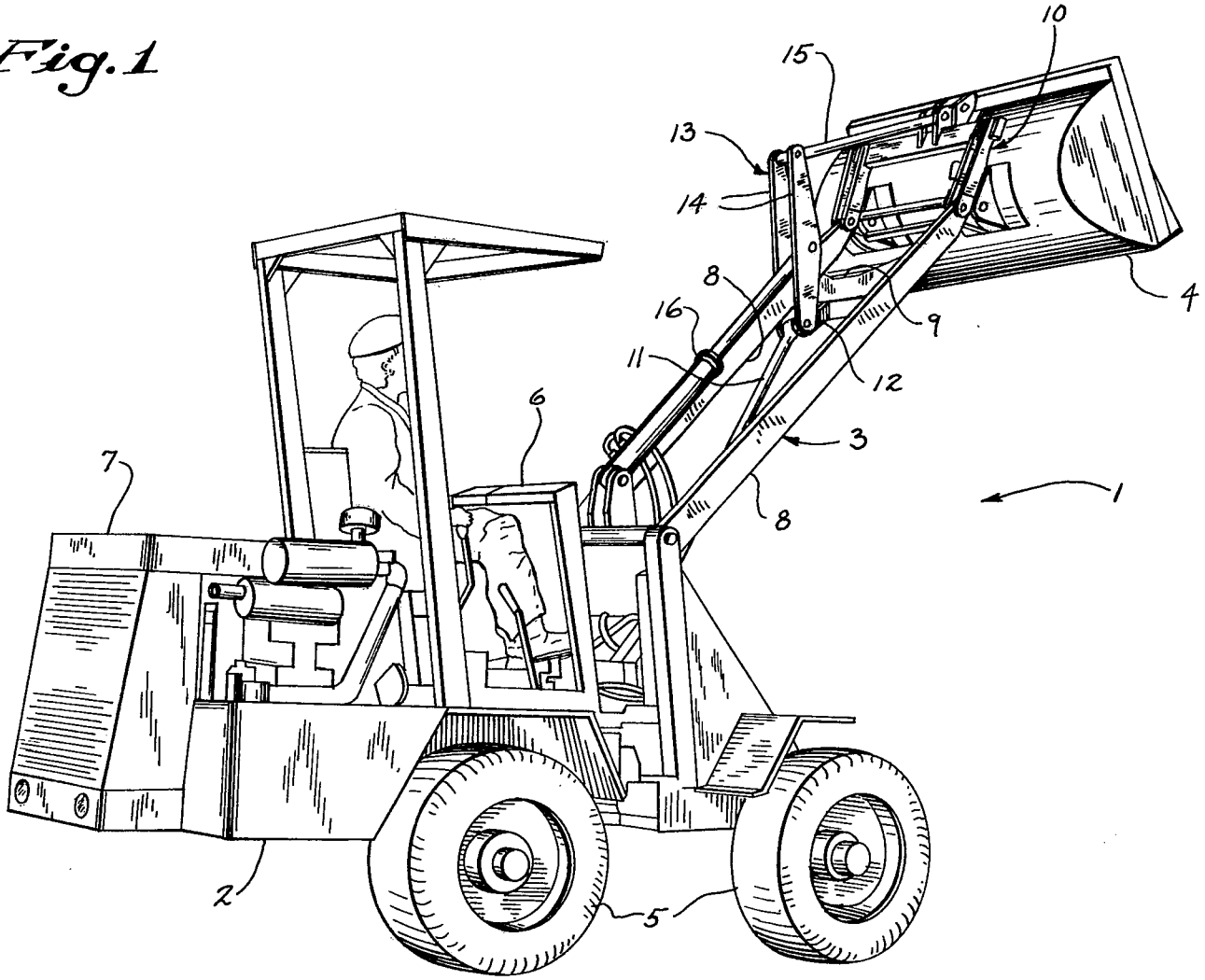
FIG. 1 is a view in perspective of a front end loader that incorporates the quick attach assembly of the present invention.

Referring now to the drawings, FIG. 1 shows a front end loader 1 which incorporates the quick attach mounting assembly of the present invention. The front end loader 1 may be of any conventional design, and generally includes a chassis 2 and a forwardly extending boom 3 with a bucket 4 attached to the outer or forward end of the boom 3. The chassis 2 is mounted on a set of wheels 5 and supports the boom 3 at its front end, an operator's station 6, and drive machinery within a housing 7 at its rear end.

The boom 3 is comprised of a pair of lift arms 8 extending forwardly from the front of the vehicle. Each lift arm 8 has its inner end or foot pivotally attached to the front of the loader chassis 2, and the arms 8 are joined together near their outer ends by a transverse girder 9 that lends support to the arms 8. The lift arms 8 are pivotally attached at their outer or forward ends to a mounting unit 10 which in turn is connected to the rear of the bucket 4 in a manner hereinafter to be described. The bucket 4 and boom 3 may be raised and lowered by a hydraulic hoist cylinder 11 having its cylinder end pivotally connected to the chassis 2 and its rod end pivotally connected between a pair of brackets 12 extending from the transverse girder 9. Extension and retraction of the rod end of the hoist cylinder 11 will thus result in raising and lowering the boom 3, mounting unit 10 and bucket 4.

The loader 1 also includes a tilt mechanism 13 used to pivot the bucket 4. The tilt mechanism 13 includes a pair of tilt linkages 14, a tilt rod 15, and a hydraulic tilt cylinder 16. The linkages 14 are pivotally connected at one end coaxially with the pivotal connection of the hoist cylinder 11 with the transverse girder 9 in such a manner that they straddle the brackets 12. The other ends of the tilt linkages 14 are pivotally connected to the tilt rod 15. The tilt rod 15 extends forwardly from the tilt linkages 14 and is pivotally connected to the upper end of the mounting unit 10. The hydraulic tilt cylinder 16 is used to actuate the tilt mechanism 13 to pivot the bucket 4, and is pivotally connected at its cylinder end to the chassis 2, and at its rod end to the tilt linkages 14. Thus, extension and retraction of the rod end of the tilt cylinder 16 pivots the mounting unit 10, and bucket 4 forwardly and rearwardly on the boom 3.

Figure 4:
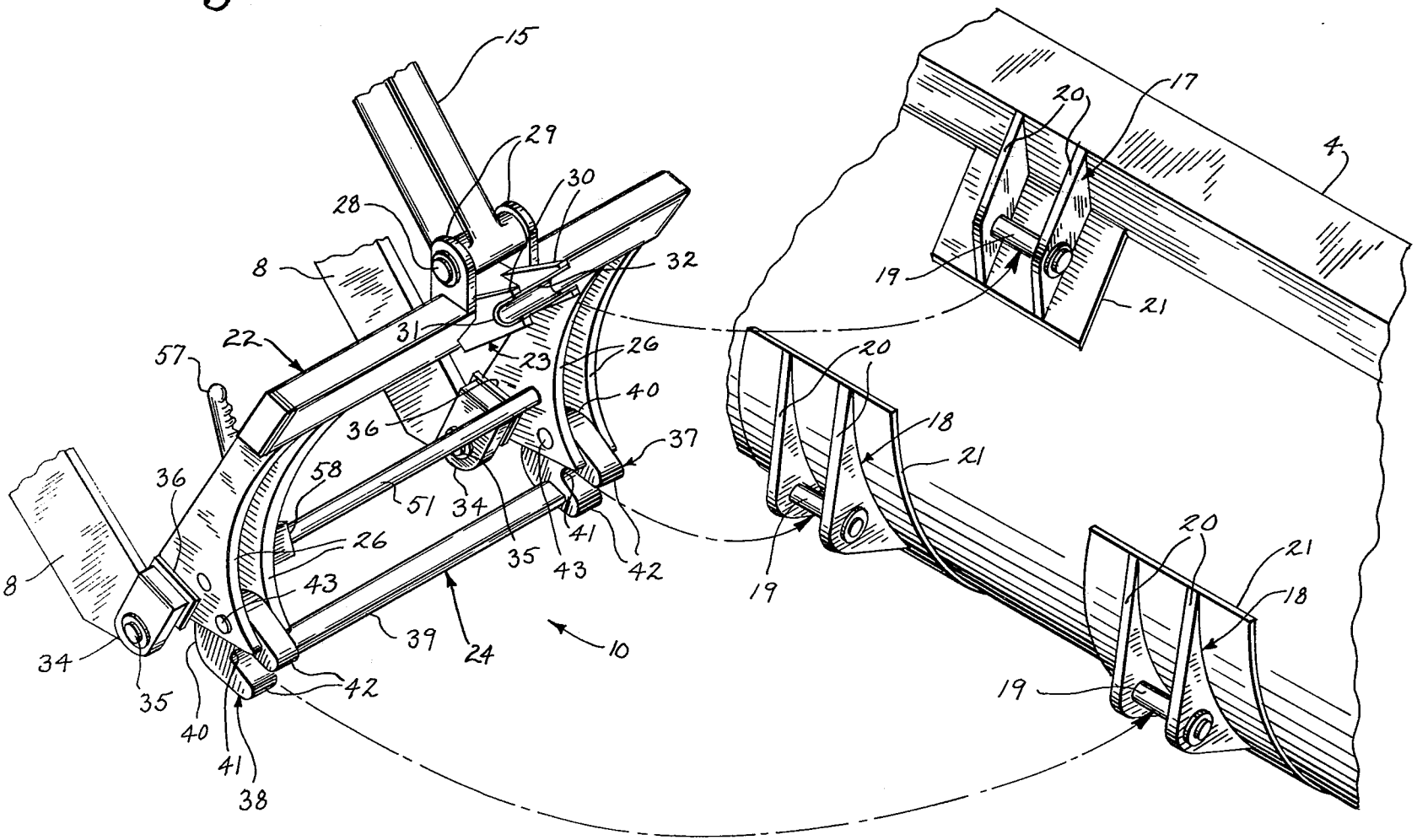
FIG. 4 is a perspective view of the quick attach assembly shown in FIG. 1 illustrating the manner in which the mounting unit is attached to the rear of a bucket implement.

Referring now to FIG. 4, there is shown upper trunnion means 17 and lower trunnion means 18 mounted on the rear of the bucket 4 in fixed spaced apart relationship. The upper trunnion means 17 includes a bracket assembly positioned medially along the top edge of the bucket 4, and the lower trunnion means 18 includes a pair of bracket assemblies positioned equidistant from each other and the sides of the bucket 4. Each of the upper and lower bracket assemblies include a short trunnion pin 19 extending between and passing through a pair of support plates 20 projecting from the rear of the bucket 4. The pins 19 thus extend transversely across the rear of the bucket 4. The support plates 20 are welded to panels 21 which in turn are welded to the rear of the bucket 4. The pins 19 are used as trunnion pivot points, or projections, which cooperate with the mounting unit 10 in a manner to be hereinafter described to connect and disconnect the bucket 4 as well as various other types of work implements to the loader 1.

Figure 3:
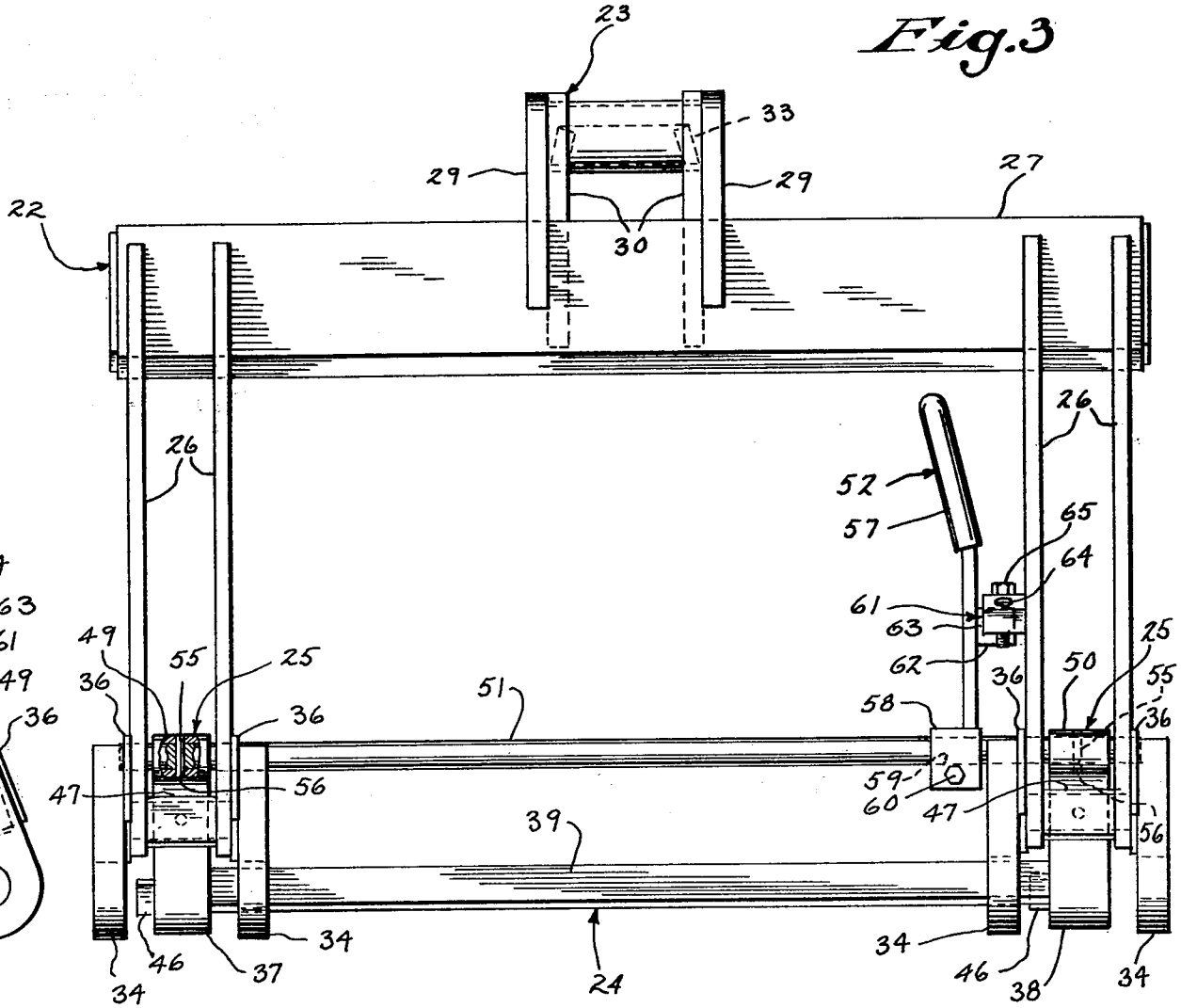
FIG. 3 is a rear view in elevation of the mounting unit of the quick attach assembly shown in FIG. 1.
Figure 2:
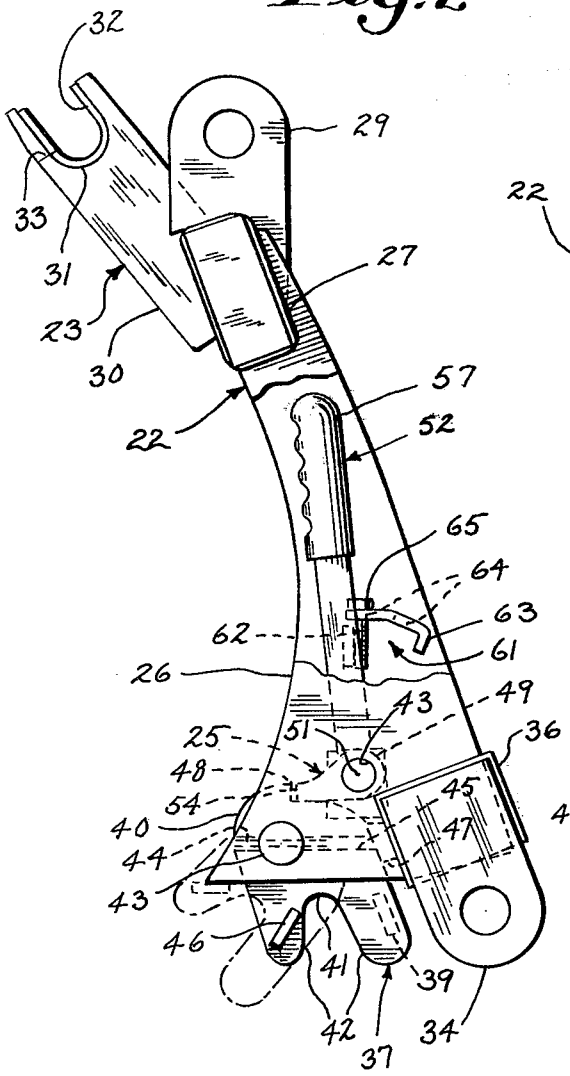
FIG. 2 is a side view in elevation with parts broken away of the mounting unit of the quick attach assembly shown in FIG. 1.

FIGS. 2 and 3 show the mounting unit 10, which constitutes an interface between the boom 3 and the implement 4. It includes a frame 22, an upper trunnion-engaging member 23 fixed at the upper center of the frame 22, a lower trunnion-engaging member 24 pivotally mounted along the bottom side of the frame 22, and a lock means 25 for releasably securing the lower trunnion-engaging member 24. The frame 22 is pivotally mounted to and interconnected between the boom 3 and tilt mechanism 13. The frame 22 includes spaced pairs of vertical end plates 26, and a hollow support beam 27 extending transversely between and welded to the upper ends of the end plates 26. The tilt rod 15 of the tilt mechanism 13 is pivotally connected to the upper end of the frame 22 by means of a pin 28 passing through a pair of brackets 29 extending upward from the support means 27. The brackets 29 are disposed medially the length of the support beam 27, and may be welded thereto.

The frame 22 is pivotally engageable with the upper trunnion pin 19 of the upper trunnion means 17 by means of the upper trunnion-engaging member 23 mounted approximately medially the length of the support beam 27 and extending forwardly at an oblique angle therefrom. The upper trunnion-engaging member 23 includes a pair of spaced plates 30 projecting from the support beam 27, and a gudgeon, or saddle 31 extending therebetween at its forward end. The saddle 31 is U-shaped and includes a mouth portion 32 opening upwardly and forwardly that is pivotally engageable with the upper trunnion pin 19 of the upper trunnion means 17. As can be seen in FIG. 3, the forward end of the upper trunnion-engaging member 23 is tapered inwardly as at 33, to help guide the member 23 into engagement with the upper trunnion pin 19.

The end plates 26 of the frame 22 are generally arcuate in shape along their front edges and extend downwardly from the support beam 27. As seen in FIG. 3, the end plates 26 are four in number to present left-hand and right-hand pairs for the frame 22. The end plates 26 are connected at their lower ends to the outer ends of the boom lift arms 8 by means of a pair of mounting brackets 34 welded to the lower ends of each pair of end plates 26. The mounting brackets 34 extend rearwardly from the end plates 26 to straddle both the lower ends of the end plates 26 and the boom arms 8. The pivotal connection of the boom arms 8 thereto is provided by a pin 35 passing through aligned openings in the brackets 34 and outer ends of the boom arms 8. Shims 36 may be disposed between the mounting brackets 34 and the lower ends of the end plates 26 as necessary in order to accommodate different widths of boom arms 8.

The lower trunnion-engaging member 24 is pivotally mounted between lower, forward corners of the end plates 26 in a position forward of the mounting brackets 34. As seen in FIG. 3, the member 24 includes a left-hand pawl 37 and a right-hand pawl 38 interconnected by a flat rod 39. Each pawl 37, 38 is generally U-shaped and includes a head portion 40 and a notched lower end, or mouth portion 41 having forward and rear lip portions 42. Each pawl 37, 38 is pivotally attached to the lower end of the frame 22 by a pivot pin 43 which extends through the adjacent pair of end plates 26 and the head portion 40 of the pawl. The pawls 37, 38 are prevented from moving laterally on the pins 43 between the end plates 26 by spring pins 44 which extend transversely through the pivot pins 43 in bores 45 formed in the pawls 37, 38. The pivotal connections of the pawls 37, 38 to the end plates 26 are eccentric of the center of gravity of each pawl 37, 38, so that when the pawls 37, 38 are hanging free they are biased forwardly by gravity to a non-engaged position in which their mouth portions 41 extend forwardly and downwardly, as shown in phantom in FIG. 2. Each pawl 37, 38 can pivot to an operative, or locking, position in which their mouth portions extend downwardly and rearwardly, as seen in solid lines in FIG. 2.

The rod 39 interconnects the pawls 37, 39 and extends between their rearward lip portions 42 to permit the pawls 37, 38 to pivot simultaneously in tandem. A limit ear 46 projects outwardly from the side of the forward lip portion 42 of each pawl 37, 38. The limit ears 46 limit the forward pivoting movement of the pawls 37, 38 in their free swinging non-engaged position by striking the undersides of the lower ends of the outside end plates 26 of the frame 22. A stop block 47 is also disposed between the left-hand and right-hand pairs of end plates 26 and behind the pawls 37, 38 to limit the rearward pivotal movement of the pawls 37, 38. When pivoting rearwardly toward their operative position, the head portion 40 of each pawl 37, 38 will engage the stop block 47 to limit any further pivotal movement. A shoulder 48 is also formed along the circumference of the head portions 40 of each pawl 37, 38 for engagement with the lock means 25.

The lock means 25 for releasably securing the pawls 37, 38 in their operative position will now be described. It includes a pair of latches 49, 50 interconnected by a rod 51, and a handle assembly 52 mounted on the rod 51 to permit manual movement of the latches 49, 50 into and out of engagement with the pawls 37, 38. Each latch 49, 50 is shaped generally like an elongated nose and has an opening 53 formed therein at one end which accommodates the rod 51. The other ends of the latches 49, 50 include abutment ends 54 which are engageable with the shoulders 48 of the pawls 37, 38 to secure the pawls in their operative position. Each latch 49, 50 is disposed between the lower ends of the end plates 26 of the frame 22, and above the pivotal connection of the pawls 37, 38 to the end plates 26, such that when they are pivoted the abutment ends 54 of each latch 49, 50 squarely engage the shoulders 48 of each pawl 37, 38. The latches 49, 50 are prevented from moving laterally on the rod 51 between the end plates 26 by pins 55 which extend transversely through the rod 51 in bores 56 formed in the latches 49, 50. The rod 51 extends between and passes through the end plates 26 of the frame 22 and interconnects the latches 49, 50 to permit simultaneous pivotal movement of the latches 49, 50.

To pivot the latches 49, 50 the handle assembly 52 is mounted alongside the right-hand pair of end plates 26. This assembly 52 includes a handle 57 mounted to the rod 51 at its base 58. The base 58 is in the form of a clamp and has a rod-receiving opening 59 formed therein. A nut and bolt assembly 60 may then be turned down and tightened to securely fasten the handle 57 on the rod 51. The handle assembly 52 also includes a stop assembly 61, best shown in FIG. 2, which secures the latches 49, 50 and handle 57 in their locked or unlocked positions. The stop assembly 61 is disposed between the handle 57 and the inside end plate of the right-hand pair of end plates 26 of the frame 22. The stop assembly 61 includes a lug 62 projecting from the handle 57 toward the inside end plate, and an L-shaped bracket 63 extending from the inside end plate toward the handle 57. The bracket 63 includes a pair of pin-receiving openings 64 formed therein, one being more forward than the other, and a lock pin 65 which may extend through either of the openings 64 to secure the handle 57 in its locked or unlocked position. Thus, to secure the handle 57 forwardly in its locked position such that the latches 49, 50 engage the pawls 37, 38 and lock them in their operative position, the handle 57 is manually moved forwardly and the lock pin 65 is inserted through the forward opening 64 in the bracket 63. Any attempt to move the handle 57 rearwardly would then cause the lug 62 on the handle 57 to interfere with the lock pin 65 and prevent such movement. To secure the handle 57 in its unlocked position such that the pawls 37, 38 may freely pivot to their non-operative position, the lock pin 65 is removed from the forward opening 64 in the bracket 63, the handle 57 is rotated rearwardly until the lug 62 engages the rearward end of the bracket 63, and then the lock pin 65 is inserted into the rearward opening 64 in the bracket 63. Thus, any attempt to move the handle 57 forwardly would cause the lug 62 to engage the lock pin 65 and prevent such forward movement. If preferred, the lock means 24 could also be operated to lock and unlock the latches 49, 50 by means of a cable system from the operator's station 6.

Referring now to FIGS. 5 through 7, the manner in which the mounting unit 10 is used to connect and disconnect the bucket 4, or some alternative form of implement, will now be described. The mounting unit 10 is mounted on the loader 1 by pivotally connecting the outer end of the tilt rod 15 between the brackets 29 extending from the support beam 27 of the frame 22, and the boom lift arms 8 between the brackets 34 extending from the lower ends of the end plates 26 of the frame 22. Following this, the operator drives the machine toward the rear of the bucket 4 with the lock means 25 unlocked and the pawls 37, 38 swinging freely in their non-engaged position. The mounting unit 10 is tilted forwardly in FIG. 5 and the upper trunnion pin 19 on the rear of the bucket 4 is aligned with the saddle 31 of the upper trunnion-engaging member 23. The operator then moves the upper end of the mounting unit 10 forwardly to engage the saddle 31 of the upper trunnion-engaging member 23, which is guided by the taper 33, with the upper trunnion pin 19.

Up to this point, it should be noted that although the pawls 37, 38 are freely pivotable they remain biased in their positions with their mouth portions 41 extending forwardly. This is due to their eccentric pivot connection to the end plates 26 of the frame 22. Upon engagement of the saddle 31 of the upper trunnion-engaging member 23 with the upper trunnion pin 19, the operator lifts the boom arms 8 slightly and tilts the mounting unit 10 rearwardly to a more vertical position, as seen in FIG. 6. Upon lifting and tilting, the bucket 4 pivots about the upper trunnion pin 19, such that the lower trunnion pins 19 swing toward the machine. As the bucket 4 swings rearwardly, the mouth portions 41 of the pawls 37, 38 engage the lower trunnion pins 19 on the rear of the bucket 4. Upon engagement of the mouth portions 41 of the pawls 37, 38 with the lower trunnion pins 19, the pawls 37, 38 pivot rearwardly to their operative, or locking position in which they engage the stop blocks 47. In their operative positions, the mouth portions 41 of the pawls 37, 38 extend downwardly and somewhat rearwardly. The latches 49, 50 of the lock means 25 may then be pivoted by the handle 57 to their locking position, whereby the abutment ends 54 of each latch 49, 50 engage the shoulders 48 of each pawl 37, 38. The lock pin 65 may then be inserted through the forward opening 64 in the bracket 63 of the stop assembly 61 to secure the handle 57 and latches 49, 50 in their locked positions. The bucket 4 is thus securely attached to the front of the vehicle 1 and is ready for operation.

To disconnect the bucket 4 from the front of the vehicle 1, the reverse of the above described steps is performed. Briefly, the handle 57 and latches 49, 50 are first rotated to their unlocked positions while the bucket 4 is suspended from the boom lift arms 8 with the mounting unit 10 in a substantially vertical position, as shown in FIG. 7. The bucket 4 is then lowered by extending the tilt cylinder 16 to move the upper end of the mounting unit 10 forwardly of its lower end. In doing this, the bucket 4 pivots forwardly about the upper trunnion pin 19. This movement also permits the pawls 37, 38 to pivot forwardly and disengage themselves from the lower trunnion pins 19 on the rear of the bucket 4. The bucket 4 is now on the ground, and the boom lift arms 8 are retracted to disengage the saddle 31 of the upper trunnion-engaging member 23 from the upper trunnion pin 19. The bucket 4 is thus disconnected from the vehicle 1 and the vehicle 1 is free to connect other work implements such as snow plows, brushes, or grapples to its front end as desired.

The invention provides a frame which functions as an interface between the outer end of a boom and a work implement. It includes a quick attach mechanism for easily mounting and detaching work implements of different types, so that the versatility of the associated machine is enhanced. At the same time, the design of the end of the boom, including its tilt, or wristing, mechanism and of the connecting pins, or projections on the rear of the work implement do not require any change. The frame forming an interface can therefore be used in existing machines, and can be inserted or removed without disturbing the ability to directly connect work implements to the boom.

It is apparent that various modifications may be made to the specific structure described. The lock means 25, for example, can be operated manually by grasping the handle 57, or alternately by an optional remote control cable from the operator's station 6. Also, various forms of pawls 37, 38 and latches 49, 50 might be substituted, and different forms of trunnion means 17, 18 might be mounted on the rear of the work implements. It is thus to be understood that various changes and modifications of the invention may be made without departing from the scope of the invention, as defined in the following claims.

I claim:

1. A mounting unit for releasably attaching a work implement to a boom and tilt mechanism of a vehicle, comprising:

a frame having end plates and a support beam extending transversely between the upper ends of said end plates, said frame being pivotally connectable at its upper end to said tilt mechanism and at its lower end to said boom;

an upper trunnion-engaging member mounted on said frame intermediate the ends of said support beam and extending forwardly therefrom, said upper member having a saddle engageable with the upper end of said work implement to pivot said work implement about said frame upon elevation of said boom;

a pair of pawls pivotally mounted on the lower ends of said end plates for simultaneous movement from a non-engaged position out of engagement with the lower end of said work implement to an operative position engageable with the lower end of said work implement upon the pivotal movement of said work implement about the upper trunnion-engaging member; and lock means including a pair of latches engageable with said pawls for releasably securing said pawls in said operative position.

2. A mounting unit in accordance with claim 1, wherein:

each of said pawls include a shoulder formed therein; and said latches include abutment ends pivotable to a position engaging said shoulders to secure said pawls in said operative position.

3. In a vehicle having a work implement, a boom for raising and lowering the implement, and a tilt mechanism for pivoting the implement, a quick attach assembly for releasably attaching the work implement to the boom and tilt mechanism comprising:

upper and lower trunnion means mounted on the rear of said work implement in fixed spaced apart relationship, each of said trunnion means including a pin extending transversely between a pair of support plates projecting from said work implement;

a frame pivotally connected at its upper end to said tilt mechanism and at its lower end to said boom;

an upper trunnion-engaging member mounted on said frame and engageable with said upper trunnion means to pivot said work implement thereon upon elevation of said boom;

a lower trunnion-engaging member pivotally mounted on said frame, said lower trunnion-engaging member being normally biased in a non-engaged position out of engagement with the lower trunnion-engaging member being normally biased in a non-engaged position out of engagement with the lower trunnion means on said work implement, and being freely pivotable to an operative position engaging said lower trunnion means upon the pivotal movement of said work implement about the upper trunnion-engaging member, said lower trunnion-engaging member comprising a pawl which includes a head portion pivotally attached to the lower end of said frame, and a mouth portion engageable with the lower trunnion pin of said lower trunnion means, said pawl includes a shoulder formed in its head portion; and lock means for releasably securing said lower trunnion-engaging member in said operative position, said lock means including a latch having an abutment end pivotable to a position engaging said shoulder to secure said pawl in said operative position.

4. A vehicle in accordance with claim 3, wherein: said upper trunnion-engaging member includes a saddle engageable with said upper trunnion pin.

5. In a vehicle having a work implement, a boom for raising and lowering the implement, and a tilt mechanism for pivoting the implement, a quick attach assembly for releasably attaching the work implement to the boom and tilt mechanism comprising:

upper and lower trunnion means mounted on said work implement in fixed spaced apart relationship, each of said trunnion means including a pin extending transversely between a pair of support plates projecting from the rear of said work implement;

a frame pivotally connected at its upper end to said tilt mechanism and at its lower end to said boom, said frame including spaced pairs of end plates and a support beam extending transversely between the upper ends of said end plates;

an upper trunnion-engaging member mounted on said frame intermediate the ends of said support beam and extending forwardly therefrom, said upper trunnion-engaging member includes a saddle engageable with said upper trunnion pin to pivot said work implement thereon upon elevation of said boom;

a pair of pawls, one of said pawls disposed between the lower ends of each pair of end plates of said frame, each of said pawls include a head portion pivotally attached to said end plates and a mouth portion engageable with said lower trunnion means, said pawls normally being biased in a non-engaged position out of engagement with the lower trunnion means on said work implement, and being simultaneously pivotable to an operative position in which their mouth portions engage the lower trunnion pins of said lower trunnion means upon the pivotal movement of said work implement about the saddle of said upper trunnion-engaging member; and lock means including a latch engageable with each of said pawls for releasably securing said pawls in said operative position.

6. A vehicle in accordance with claim 5, wherein said lock means further includes:

a rod extending between the end plates and interconnecting said latches to permit simultaneous movement of said latches; and a handle mounted on said rod to permit manual movement of said latches.

* * * * *

UNITED STATES PATENT AND TRADEMARK OFFICE

CERTIFICATE OF CORRECTION

PATENT NO. : 4,253,793

DATED : March 3, 1981

INVENTOR(S) : Michael T. Braml

It is certified that error appears in the above–identified patent and that said Letters Patent are hereby corrected as shown below:

Column 4, line 59, "means" should be --beam--.

Column 5, line 52, "37, 39" should be --37, 38--.

Signed and Sealed this

Thirtieth Day of June 1981

[SEAL]

Attest:

RENE D. TEGTMEYER

Attesting Officer

Acting Commissioner of Patents and Trademarks